US006591904B2

(12) United States Patent
Cicognani

(10) Patent No.: US 6,591,904 B2
(45) Date of Patent: Jul. 15, 2003

(54) EQUIPMENT FOR STOWING AND HANDLING DRILL PIPES

(75) Inventor: Claudio Cicognani, Cesena Forli (IT)

(73) Assignee: Soilmec S.p.A., Cesena (IT)

( * ) Notice: Subject to any disclaimer, the term of this patent is extended or adjusted under 35 U.S.C. 154(b) by 23 days.

(21) Appl. No.: 09/862,115

(22) Filed: May 21, 2001

(65) Prior Publication Data

US 2002/0000333 A1 Jan. 3, 2002

(30) Foreign Application Priority Data

May 23, 2000 (IT) ..... TO2000A0466

(51) Int. Cl.[7] ..... E21B 19/18

(52) U.S. Cl. ..... 166/77.51; 166/77.53; 175/52; 175/85; 414/22.51; 414/22.63

(58) Field of Search ..... 166/77.51, 77.53; 175/52, 85; 414/22.51, 22.52, 22.63, 22.64, 22.65–22.71

(56) References Cited

U.S. PATENT DOCUMENTS 4,765,401 A 8/1988 Boyadjieff
5,375,667 A * 12/1994 Trevisani ..... 175/52
5,437,527 A 8/1995 McGill et al.
5,647,443 A 7/1997 Broeder

FOREIGN PATENT DOCUMENTS

| | | |
|---|---|---|
| DE | 198 37 692 | 3/2000 |
| EP | 0 886 033 | 12/1998 |
| EP | 0 978628 | 2/2000 |
| WO | 00/11305 | 3/2000 |

* cited by examiner

*Primary Examiner*—David Bagnell
*Assistant Examiner*—Giovanna M Collins
(74) *Attorney, Agent, or Firm*—Merchant & Gould, P.C.

(57) ABSTRACT

Equipment (1) for stowing and handling drill pipes (2), the equipment being provided with a device for transporting the drill pipes (2) from a service well (9) to a rack container (11); the transport device being defined by a central control tower (23) located in front of the container (11) and being able to rotate around an axis of vertical rotation (A) and by a grip device (24) supported by the central tower (23) and movable together with, and in relationship to, the central tower itself from a working grip position at the well (9) to a working release position at the bin (12) of the container (11).

7 Claims, 14 Drawing Sheets

Figure 1A:
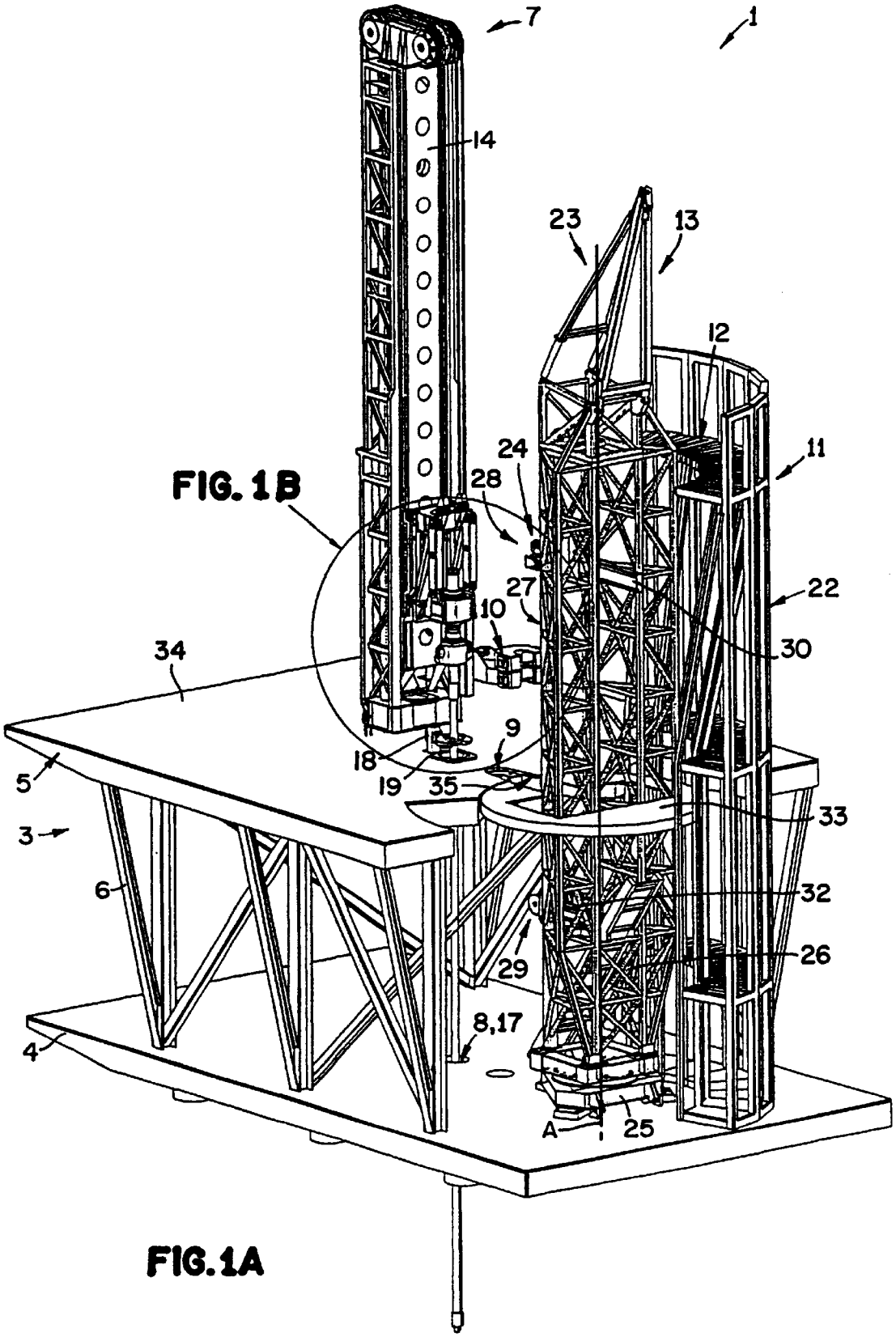

7
1

14
2
13
23
12
11
24
30
10
27
34
5
26

9
18
33
6
29
4
8,17
25
3
22

7
1

14

2
23
13
12
11
27
10
30

26
34
18
5
9
33
6
29
8,17
3
4
25
22

1
7

14
23
13

12
11
2

30

5
34
26
27
35
36
33
6
32
8,17
25
3
4
22

EQUIPMENT FOR STOWING AND HANDLING DRILL PIPES

DESCRIPTION

The present invention refers to an equipment for stowing and handling drill pipes. Generally speaking, a known type of equipment for stowing and handling drill pipes includes:

- a device to take the drill pipes out from a well consisting of a drilling derrick, a power head that moves vertically along the tower itself in order to take one drill pipe at a time out from the well, and of a pantograph support located between the head and the tower, and adapted to allow the head to translate horizontally from and to the tower itself;
- a manual device adapted to decouple the drill pipe that has been taken out, from a drill pipe which is still partially inside the well;
- a feeding device for each drill pipe inside a service well placed at one side of the well;
- a rack container located next to the service well and presenting a predetermined number of vertical bins intended to house the pipes; and
- a transport device basically manually controlled intended to move the pipe from the service well to one of the bins of the container.

Notwithstanding the safety measures adopted in order to reduce errors, and in spite of all the automatic functions implemented in order to reduce the need for human interventions, the equipment of the type described above still presents a few drawbacks the effects of which are visible mainly in the case in which the wells to be drilled are very deep so that it is necessary to use a great number of drill pipes. In this case, in fact, the need for human intervention in order to decouple the two pipes and transfer them inside the container lengthens the time needed to take the pipes out so that, at the same time, the possibility for errors to occur becomes higher.

Besides, since each pipe is at least ten meters long, it is quite complicated to move them and highly skilled staff is needed to do it: it goes without saying that this affects the rapidity required to perform the manoeuvres.

It is an object of the present invention to provide an equipment for stowing and handling drill pipes, the equipment including:

- extraction means to take each pipe in succession out from a well;
- decoupling means to decouple the pipe taken out from a pipe which is still inside the well;
- feeding means for each pipe inside a service well located at one side of the well;
- a rack container located next to the service well and presenting a determined number of vertical bins intended to house the pipes; and
- transport means to carry the pipe from the service well to the rack container;

the equipment being characterised in that said transport means include a central control tower located in front of said container and adapted to rotate around a vertical axis of rotation and a grip device supported by the central tower and movable together with, and in relationship to, the central tower itself from a working grip position at the well to a working release position at the one of the bins of the container.

Figure 1B:
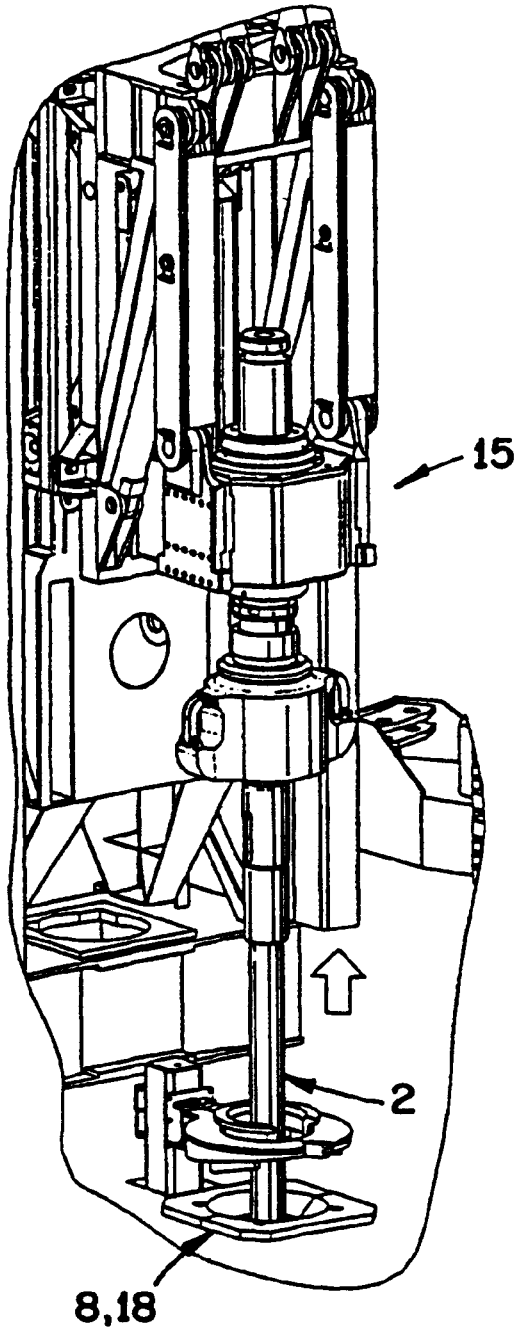
Figures 2A, 2B, 2C:
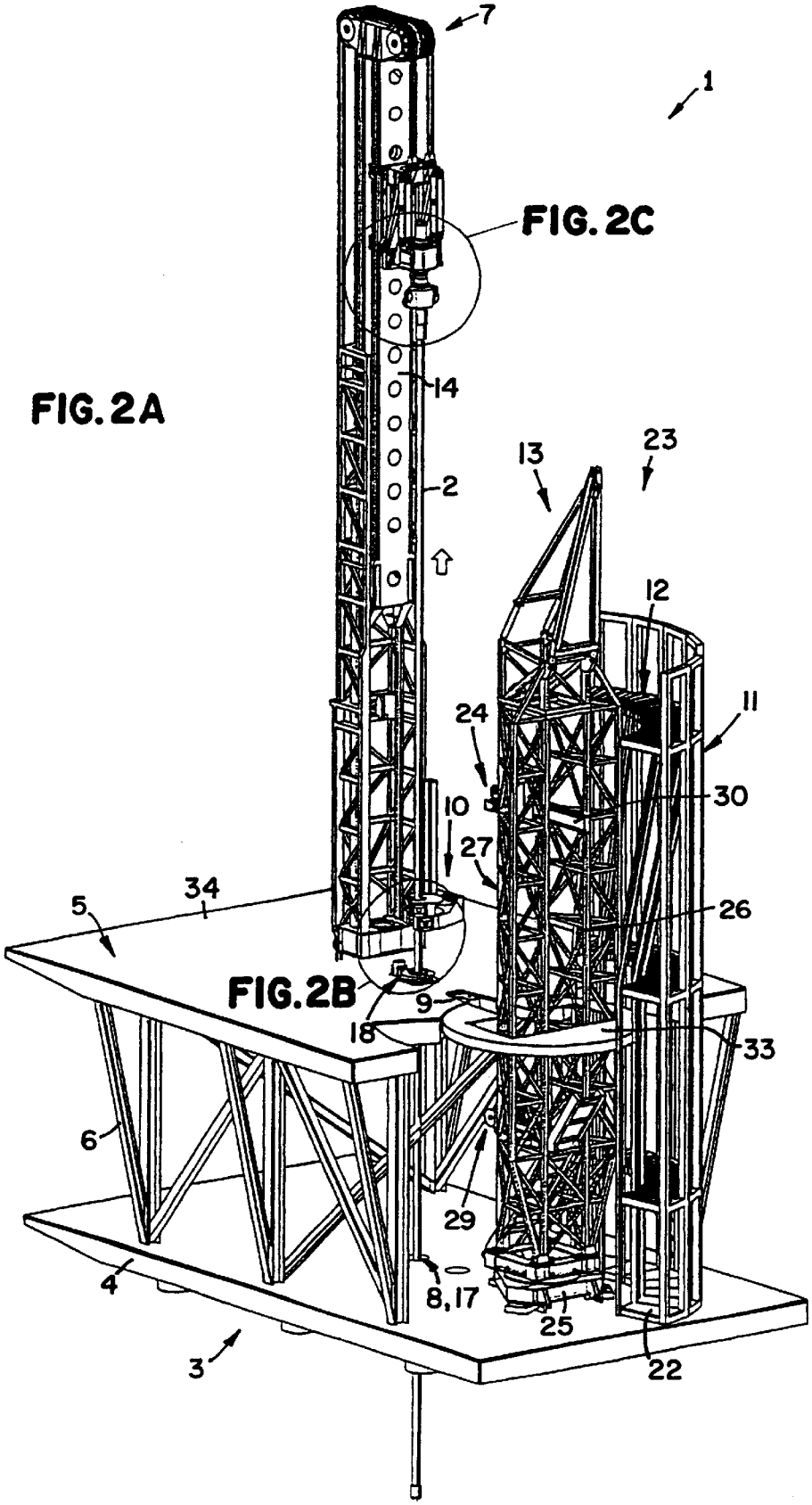
Figure 2C:
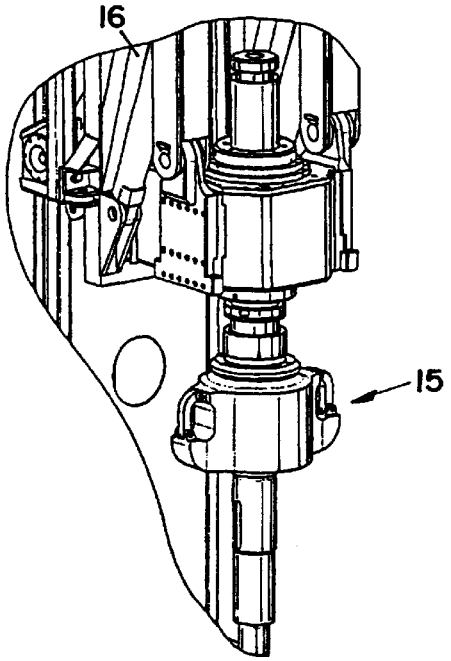
Figure 2B:
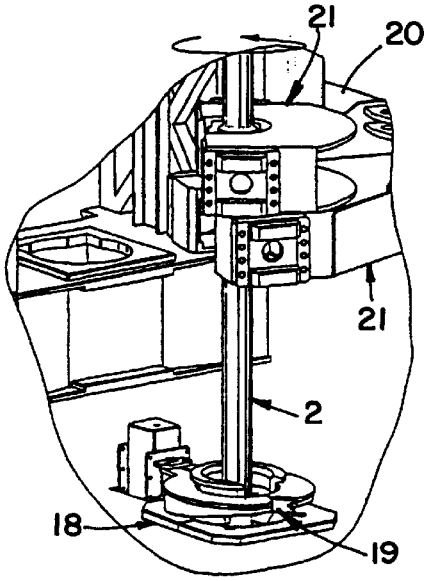
Figures 3A, 3B, 3C:
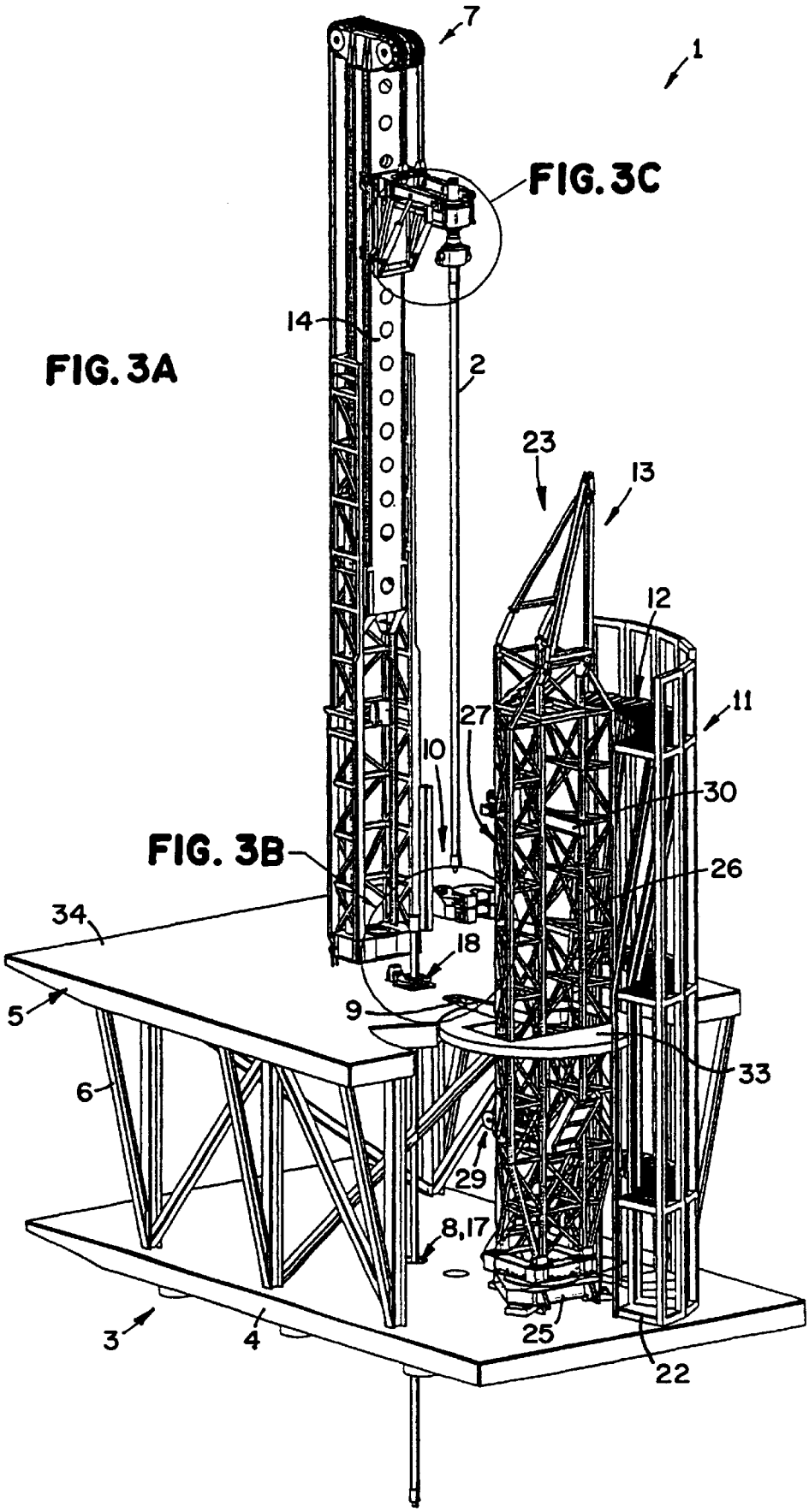
Figure 3C:
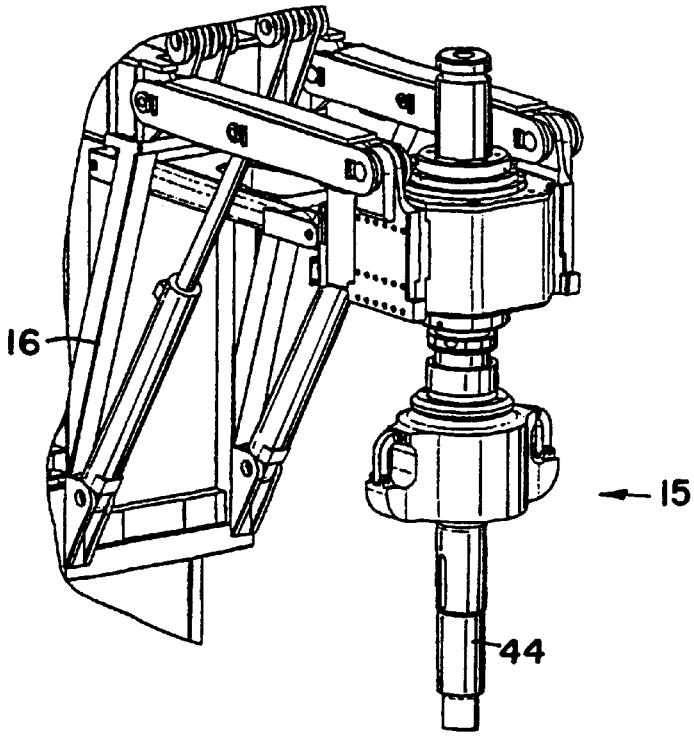
Figure 3B:
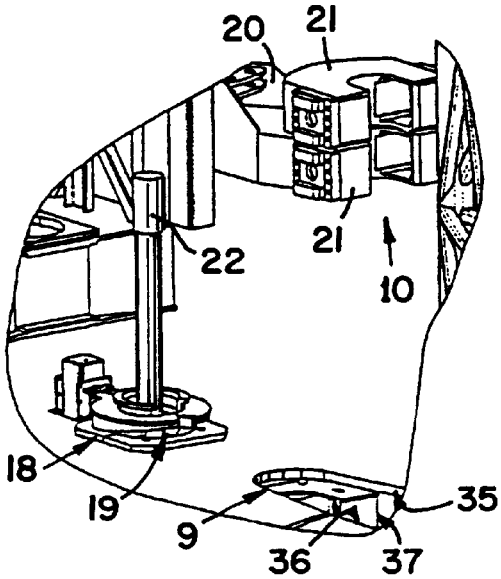
Figure 4A:
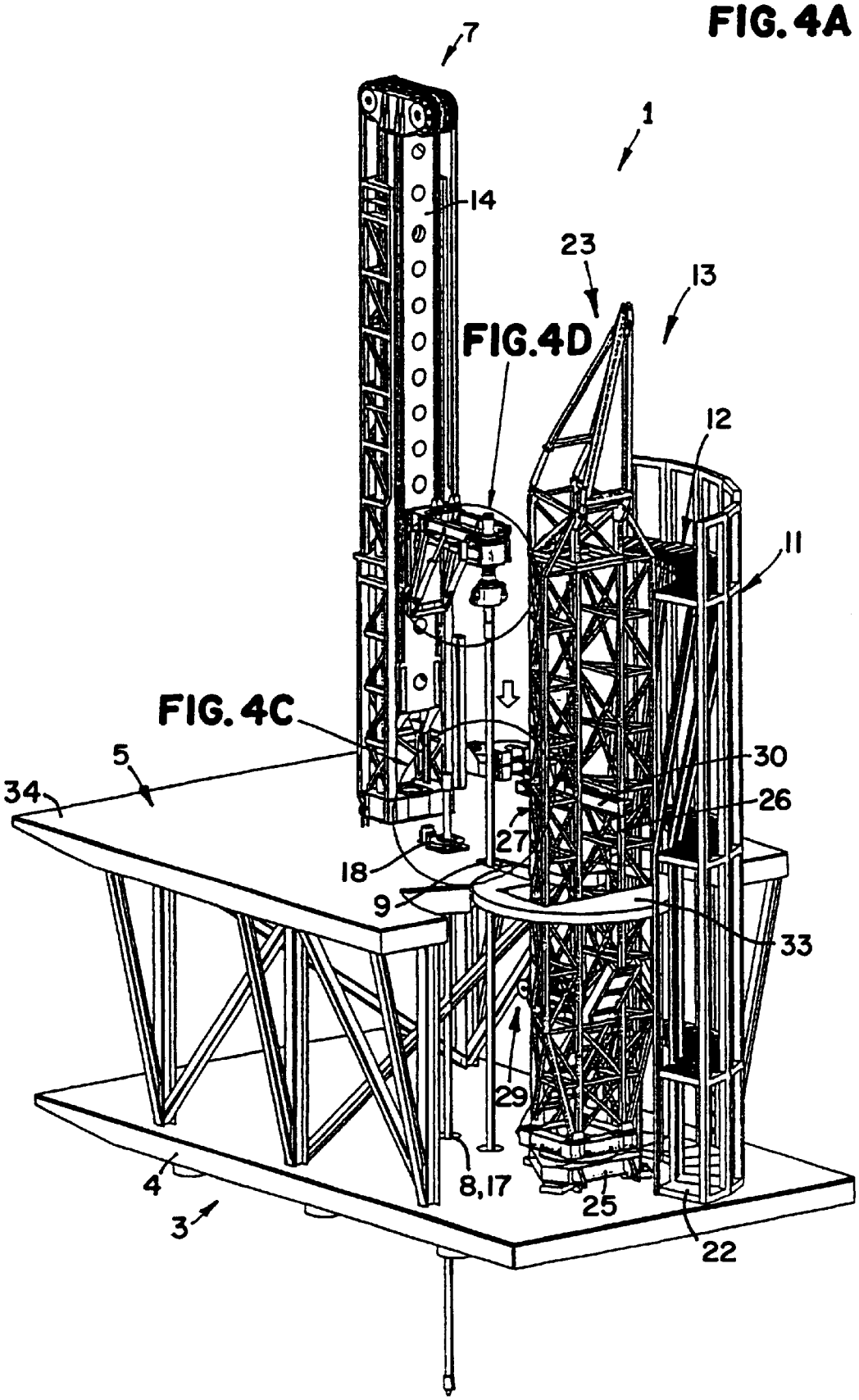
Figure 4D:
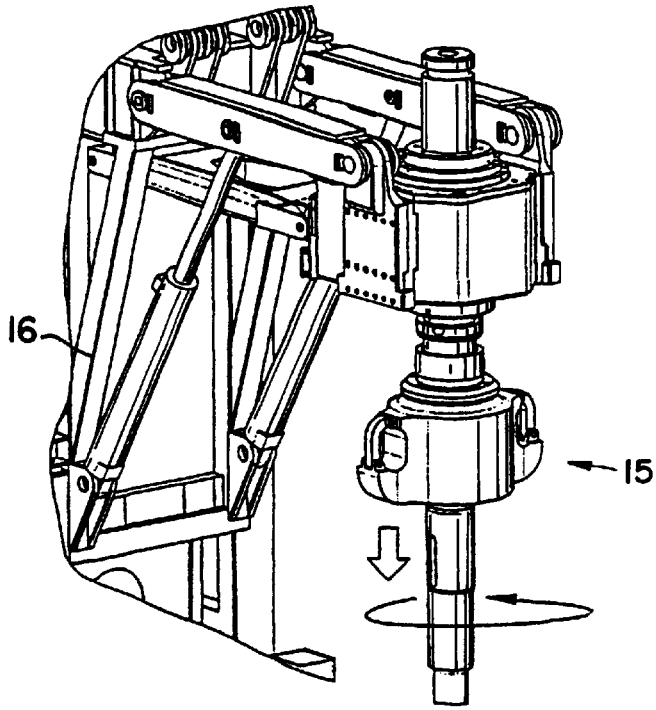
Figure 4C:
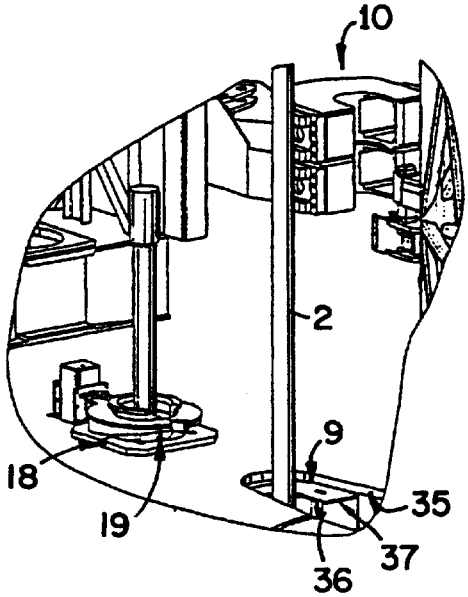
Figure 4B:
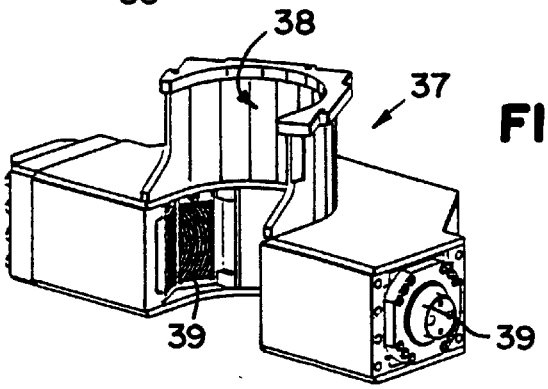
Figures 5A, 5B, 5C, 5D, 5E:
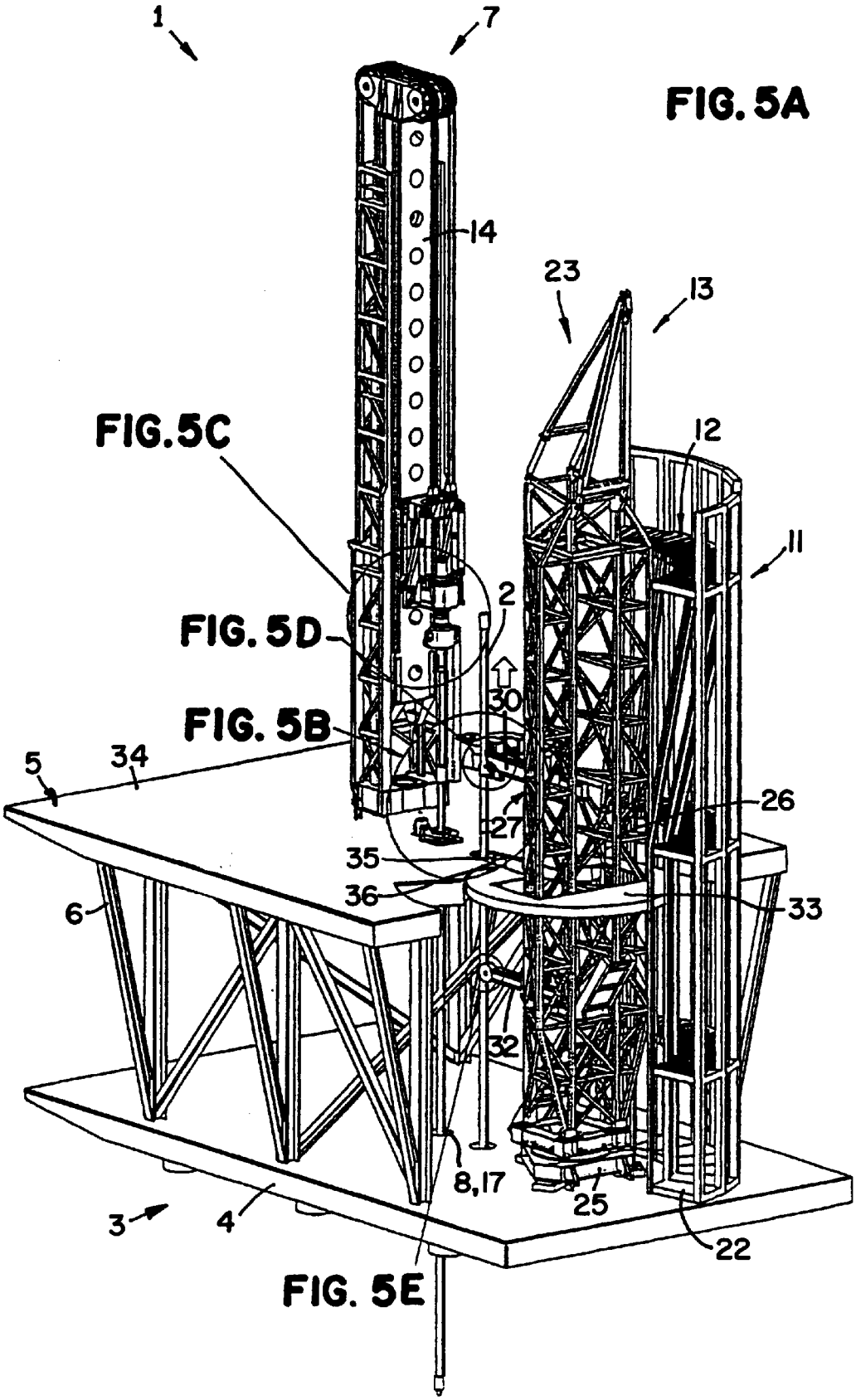
Figure 5C:
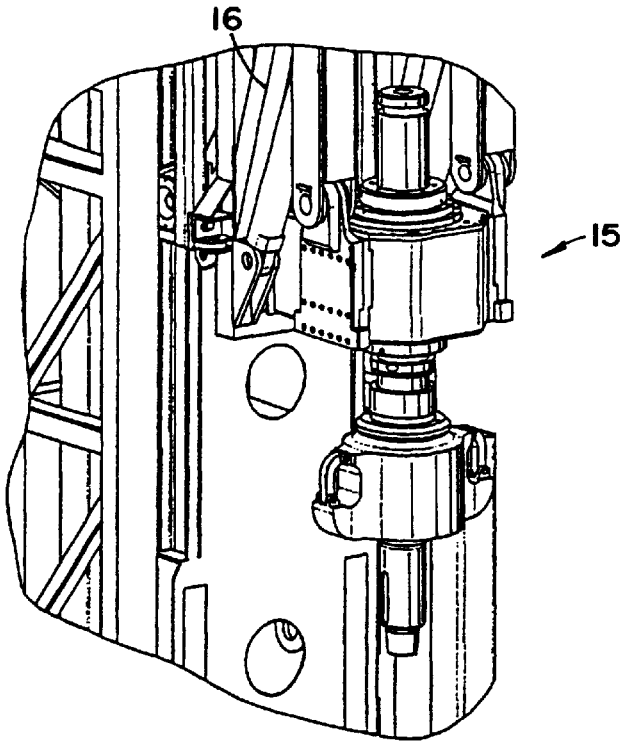
Figure 5B:
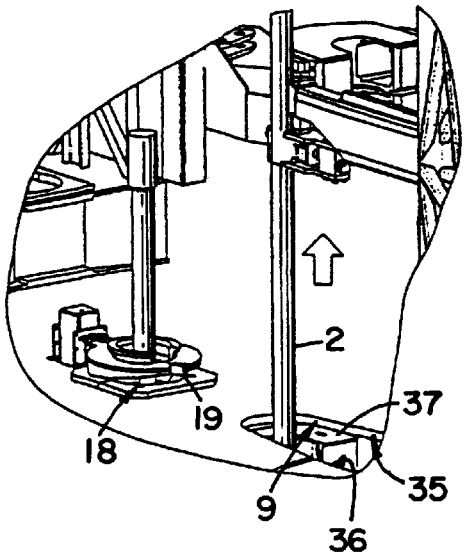
Figure 5D:
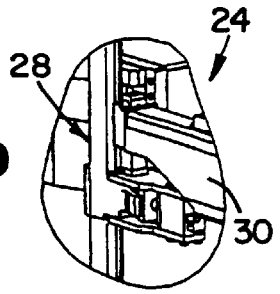
Figure 5E:
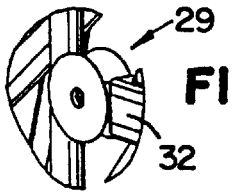
Figures 6A, 6B:
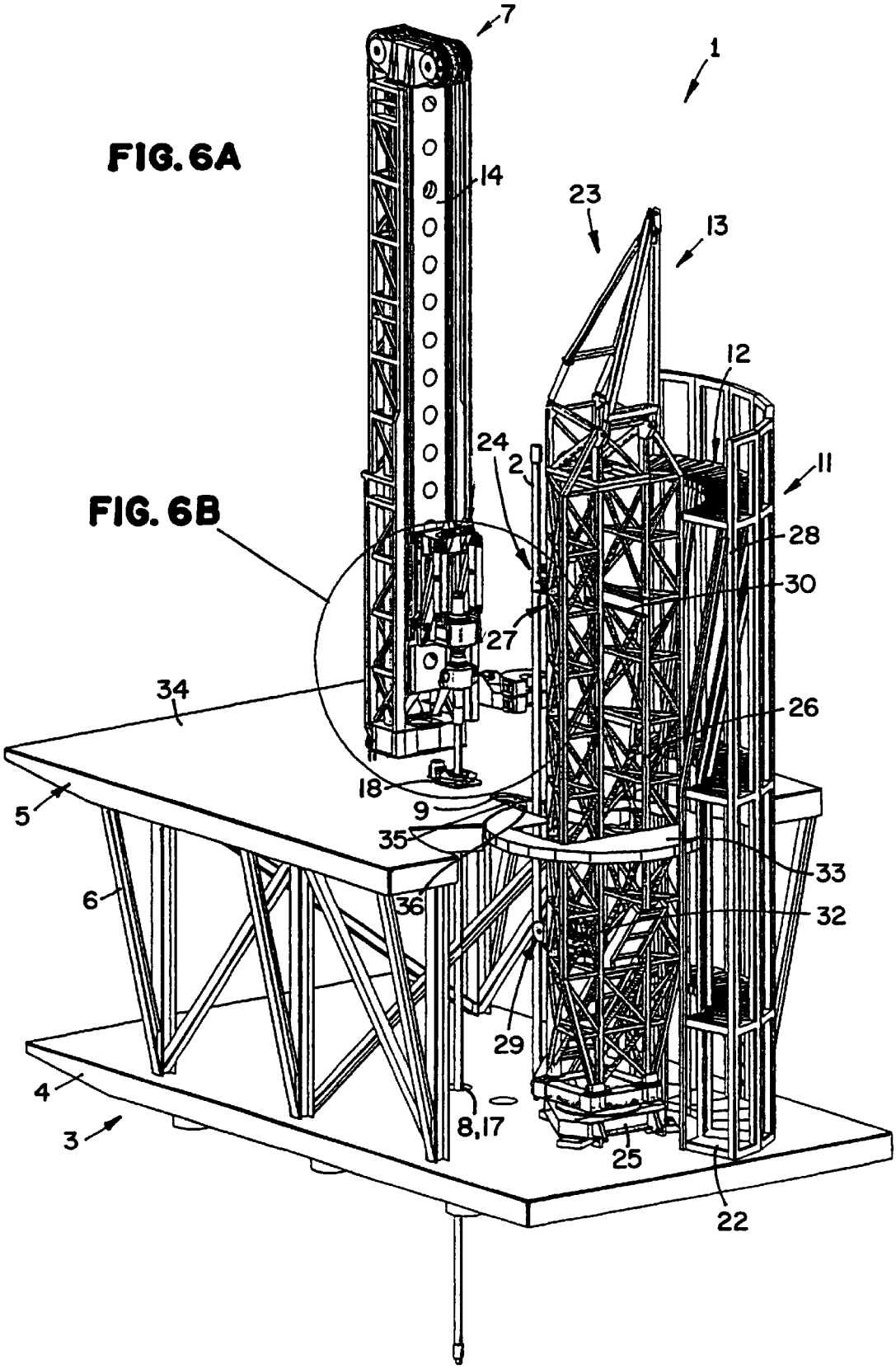
Figure 6B:
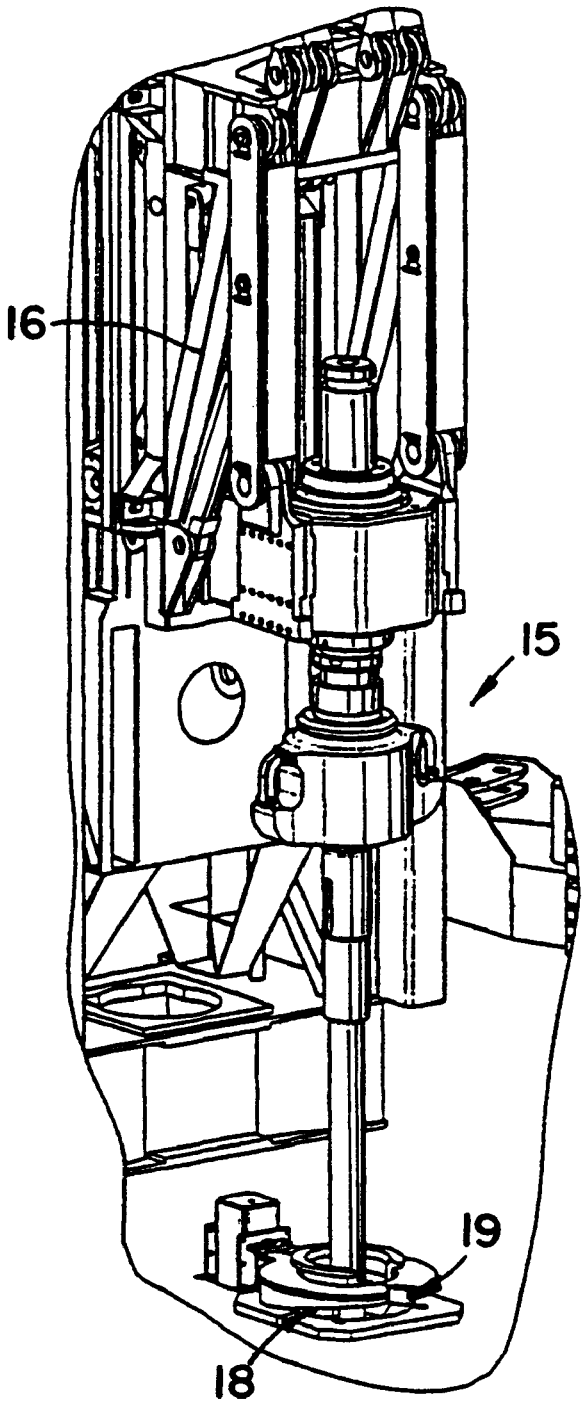
Figure 7A:
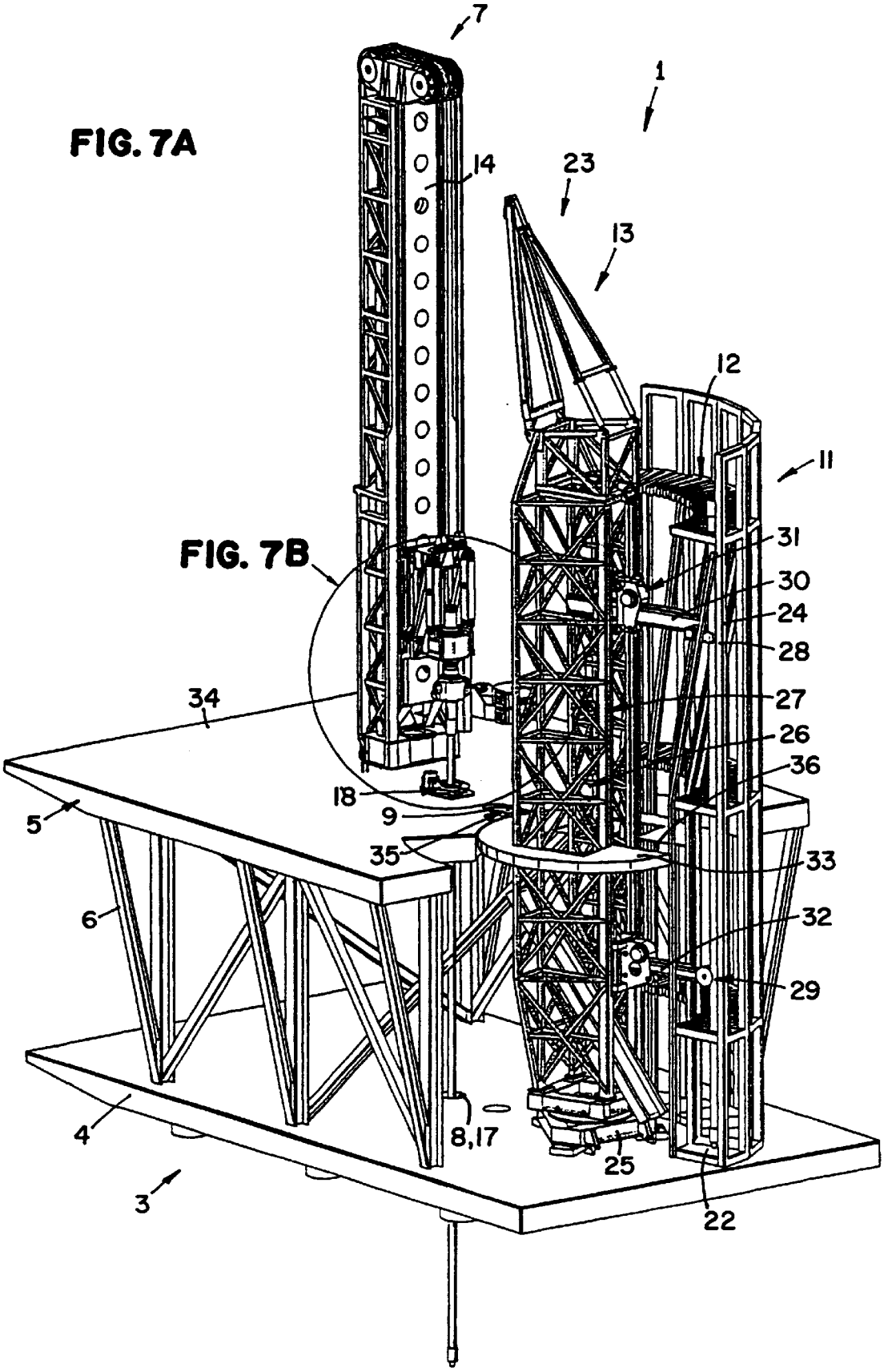
Figure 7B:
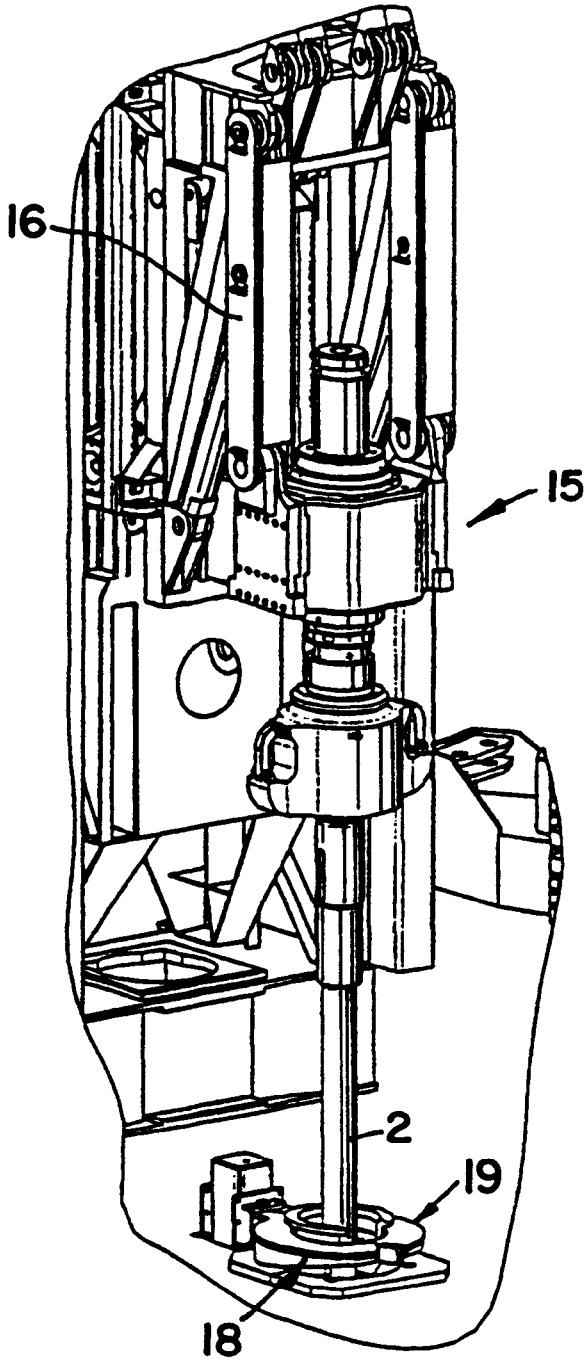

In the following the invention will be described with reference to the appended drawings, in which:

FIGS. 1A and 1B illustrate an embodiment of equipment for stowing and handling drill pipes;

FIGS. 2A, 2B, and 2C illustrate the equipment of FIG. 1A with an arm of an extraction device of the equipment positioned about a first drill pipe;

FIGS. 3A, 3B, and 3C illustrate the equipment of FIG. 1A with a head of the equipment raised and translated horizontally as it carries the first drill pipe;

FIGS. 4A, 4B, 4C, and 4D illustrate the equipment of FIG. 1A with the head of the equipment lowered to introduce the first drill pipe into a service well of a control unit;

FIGS. 5A, 5B, 5C, 5D, and 5E illustrate the equipment of FIG. 1A with the head translated back horizontally and positioned above a second drill pipe and the first drill pipe being translated upward by a group;

FIGS. 6A and 6B illustrate the equipment of FIG. 1A with the first drill pipe translated by the group towards a rack container; and FIGS. 7A and 7B illustrate the equipment of FIG. 1A with the first drill pipe positioned in one of the bins of the rack container.

With reference to FIGS. 1A and 1B, reference number 1 indicates the overall equipment for stowing and handling drill pipes 2.

The equipment 1 includes a support frame 3 defined by a base 4 that can be installed directly in contact with the ground and by a platform 5 located at a determined distance from the base 4 and connected with the base 4 itself through a certain number of beams 6.

Besides, the equipment 1 includes an extraction device 7 intended to take each pipe 2 in succession out from a well 8 and adapted to place the pipe 2 taken out into a service well 9 located at one side of the well 8 itself; a device 10 to decouple the pipe 2 taken out from a pipe 2 still partially inside the well 8; a rack container 11 located near the well 9, and presenting a determined number of vertical bins 12 to house the pipe 2; and a group 13 to carry each pipe 2 from the well 9 to the container 11 presenting an axis A of rotation which is parallel to the well 8.

The extraction device 7 is one of the type which is generally used in drilling derricks, and is mounted above the platform 5, and includes a drilling tower 14, a power head 15 which moves along the tower 14 itself in order to take the pipes 2 out of the well 9 one at a time, and a pantograph support 16 located between the head 15 and the tower 14 and adapted to allow the head 15 to translate horizontally from and to the tower 14 itself.

More in particular, the base 4 and the platform 5 present respective holes 17, as well as 18 through holes respectively, the through holes being aligned and defining the upper wall of the well 8, the tower 14 being located basically at the hole 18. Besides, just at the hole 18, between the tower 14 and the hole 18 itself, the device 7 is provided with a locking vice 19 adapted to be crossed by a pipe 2, taken out from the well 8, and to lock in a separated position a pipe 2 partially taken out from the well 8 itself.

The decoupling device 10 is a completely automatic device, requiring no human intervention for its positioning or its operation and includes: a control arm 20 rotatably supported by the tower 14; and two tongs elements 21 which, as shown in FIGS. 2A and 2B, are mounted the one on top of the other on a free end of the arm 20 itself and adapted to rotate in the mutual opposite direction in order to separate a pipe already taken out 2 from a pipe 2 locked by the vice 19.

More in particular, the arm 20 is adapted to rotate from a working position shown at one side of the tower 14 to an engaged working position in which both elements 21 are coupled to a respective coupling 44 which is present at the end of each pipe 2 in order to allow the coupling to the adjacent pipe 2. One of the two elements 21 is integral with the arm 20, while the other can rotate in relationship with the arm 20 itself, and therefore in relationship with the other element 21.

The container 11 is supported by the base 4, extends through the platform 5 and presents a determinate number of bins 22 located along an arch of a circle presenting a determined opening which varies according to the conditions in which the equipment 1 is used. Each section 22 includes at least three bins 12, each one being adapted to house at least seven pipes 2, the bins being placed according to respective radial directions passing through the axis of rotation of the transport group 11.

The group 13 includes a central control tower 23 located in front of, and inside the, container 11 and a grip device 24 supported by the central tower 23 and movable together with, and in relationship to, the tower 23 itself from a working grip position, shown in FIG. 5 in which it is taking a pipe 2 placed in the well 9, to a working release position, shown in FIG. 7, in which it is placing the pipe 2 itself inside one of the bins 12 of the container 11.

The tower 23 includes a support base 25 which is integral with the base 4 and a trestle column 26 mounted through the platform 5 and rotatably supported by the base 25 itself in order to make also the grip device 24 rotate around the axis A, the grip device, on the other hand, includes a guide 27 which is parallel to the axis A and integral with the column 26, a tongs element 28 and a contrast element 29 which are vertically aligned. The elements 28 and 29 can make co-ordinate movement transversally to the axis A, the element 28 being slidingly mounted at the end of the guide 27 in an axially fixed position in relationship to the guide 27 itself.

The tongs element 8 is located at the end of an arm 30 which is supported by a slide 31 slidingly mounted along the guide 27, being in turn slidingly mounted in relationship to the slide 31 in order to move the element 28 transversally to the axis A. The element 29 is defined by a wheel revolving around a respective axis transversal to the axis A and is in turn located at the end of a respective arm 32, which is directly supported by the tower 23 in such a way that it can slide in relationship to the tower 23 itself in order to move the element 29 transversally to the axis A.

Finally, the platform 5 includes a mobile part 33 which is integral with the tower 23 and a fixed part 34, through which the hole 18 is made, and through which it is made also a recess 35 being this open towards the mobile part 33 itself and defining an upper portion of the service well 9. The mobile part 33 is mounted on the tower 23 in a position which is basically in the middle of the two elements 28 and 29, and presents, at the guide 27, a through groove 36 adapted to be aligned to the recess 35 when the device 24 is placed in its working grip position.

According to FIGS. 4A, 4B, 4C, and 4D, the fixed position 34 is provided, at the recess 35, with a respective locking device 37 adapted to lock a pipe 2 inside the well 9 and adapted to cooperate with the head 15 while decoupling the pipe 2 from the head 15 itself. The device 37 includes a semi-cylindrical seat 38 which is co-axial to the well 9, and two pistons 39 located at the opposite sides of the seat 38 itself transversally to the recess 35 and movable from and to the inside of the seat 38 in order to lock a pipe 2.

The operation of the equipment 1 is determined by a computerised control unit U and takes place either completely automatically, that is with no intervention by the staff in charge of the extraction plant, or in a partially automatic way, that is under a minimum supervision by the people in charge of the stowing operation through a central board of the unit U itself: anyway, in both cases, none of the staff member will have to stay in the operational area of the equipment 1.

In the following the operation of the equipment 1 will be described starting from the moment in which a drilling tool, located at the head of a column of pipes 2 connected the one to the other at their respective ends, is to be replaced or has to be submitted to maintenance so that the whole column of pipes 2 is to be taken out, one pipe at a time, from the well 8.

When the control unit U sends to the power head 15 the order to start the extraction, the power head stops its rotational drilling and moves vertically along the tower 14 until the pipe 2 which is directly connected to it is completely taken out from the well 8, or until the two couplings 44, of both the pipe 2 which has been taken out and the pipe 2 which is still partially inside the well 8, are positioned a little above the vine 19 and at the same level as the action plane of the decoupling device 10 (FIGS. 1A and 1B).

At this moment, the unit U operates the locking vine 19 which locks the pipe 2 that has been partially taken out, and operates also the device 10 the arm of which, thanks to its rotation around the anchoring point to the tower 14, brings the two tongs element to grip the couplings 44 mentioned above. The automatic rotation of the upper element 21 in relationship to the lower element 21 makes the pipe 2 already taken out to get disengaged from the other pipe 2 (FIGS. 2A, 2B, and 2C).

While the arm 10 is going back to its working position shown at one side of the tower 14, the head 15 is further lifted up along the towey 14 and the pantograph support makes the head 15 translate horizontally so that the pipe 2 is again gripped to the head 15 itself on the vertical line of the service well 9 (FIGS. 3A, 3B, and 3C). Therefore, as FIGS. 4A, 4B, 4C, and 4D show, the head 15 lowers until at least half of the length of the pipe 2 is introduced inside the well 9 and once the head 15 stops, the locking device 37 is activated so that it locks the pipe 2 thus preventing any rotational or axial movement. A simple rotation of the head 15 releases the pipe 2 completely and allows the head itself to get back to the starting position in order to take out a new pipe.

While the head 15 is taking again its position, the grip device 24, the height of the grip element of which is basically the same as that of the operational plane of the device 10, is moved radially in relationship to the axis A, so that the element 8 can catch the pipe 2 and the element 29 can rabbet against the part of the pipe 2 which is below the platform 5 thus reducing, or even nullifying the possible oscillation of the pipe 2 (FIGS. 5A, 5B, 5C, 5D, and 5E).

In order to achieve a maximum reduction of each stowing cycle, the height of the free coupling 44 of the pipe 2 that has just been taken out, that is the height from the beginning of the back run of the head 15, is such that a lower portion of the pipe 2 which is locked by the device 37 is placed inside the prolongation of the well 9 through the base 4, so that once the element 28 is holding the pipe 2 and the pistons 39 or the device 37 have released the pipe 2 itself, this one is vertically lifted up by means of a displacement of the slide 31 along the guide 27: during this displacement the element 29 will roll along the pipe 2.

At this moment (FIGS. 6A and 6B) the two arms 30 and 32 are taken back and the pipe 2, which is still kept against the element 29 by the element 28, is passed through the recess 35 inside the channel 36. The unit U will then rotate the column 26 around the axis A so that the elements 28 and 29 are positioned in front of one of the sectors 22 of the container 11, and the radial sliding of the arms 30 and 32 make the pipe 2 become inserted into one of the bins 12 of the container 11 (FIGS. 7A and 7B). It is obvious that the bin 12 where the pipe 2 is to be placed will be determined by the control software of the unit U so that rotations of the column 26 are maximally reduced.

After the pipe 2 is released inside the container 11, the transport device 13 goes back to its extraction position and waits for a new pipe 2 which, meanwhile, the head 15 has already taken out and fed inside the well 9.

The cycle described above will be repeated until the column of pipes 2 will be completely taken out from the well 8, and will be followed in reverse order when the column of pipes 2 is to be formed inside the well 8.

It is quite evident from the previous description that the equipment 1 and the unit U require a minimum human intervention—if not none at all—with consequent advantages as far as operational speed and safety are concerned.

It is to be understood that the invention is not limited to the embodiment here described and shown, being it a non-restrictive embodiment of the equipment for stowing and handling drill pipes and being it possible to modify it in its form, element location and building and assembling details.

What is claimed is:

1. Equipment for stowing and handling drill pipes, the equipment including:

extraction means to take each drill pipe in succession out from a well;

means to decouple the drill pipe that has been taken out from a drill pipe which is still partially inside the well;

means to feed each drill pipe inside a service well placed at one side of the well;

a rack container located next to the service well and presenting a predetermined number of vertical bins intended to house the pipes; and transport means to move the pipe from the service well to the rack container, the transport means including a central control tower located in front of said container and adapted to rotate around a vertical axis of rotation and a grip device supported by the central tower and movable together with, and in relationship to, the central tower from a working grip position at the well to a working release position at one of the bins of the container;

wherein the extraction means includes a support platform which is vertically crossed by the transport means and the container, the support platform including a mobile part which is integral with the central tower and a fixed part which is provided with a through hole for the well and with a recess which is open towards the mobile part and which defines an upper portion of said service well, and a base which is parallel to said support platform and supports the platform; and wherein the central tower includes a support base which is integral with the base and a control column which is mounted through the mobile part of the platform and rotatably supported by the support base in order to rotate around said axis of rotation together with the mobile part.

2. Equipment as claimed in claim 1, further comprising a locking means placed at said recess intended to lock a pipe inside the well and to work together with said extraction means in order to disengage the pipe from the extraction means.

3. Equipment as claimed in claim 1, wherein the grip device includes a guide which is parallel to the axis of rotation and is supported by the control column, as well as a tongs element which in turn includes a tong support slidingly mounted along the guide.

4. Equipment as claimed in claim 3, wherein said tong support includes a mobile arm transverse to the guide.

5. Equipment as claimed in claim 4, wherein the grip device includes an element located on the opposite side of the tongs element in relationship to the mobile part of the platform.

6. Equipment as claimed in claim 1, wherein said decoupling means are automatic means including a control arm rotatably supported by the extraction means and two tongs elements mounted one on top of the other on a free end of the control arm which rotate in a mutual opposite direction in order to separate a pipe that has been taken out from a pipe which is still partially inside the well.

7. Equipment as claimed in claim 1, wherein said extraction means includes a derrick tower, a power head which moves vertically along the derrick tower in order to take the pipes in succession out of the well and a pantograph support located between the head and the derrick tower, and adapted to allow the head to translate horizontally.

* * * * *